US006918338B2

(12) United States Patent
Thiessen et al.

(10) Patent No.: US 6,918,338 B2
(45) Date of Patent: Jul. 19, 2005

(54) PRINTING SYSTEM

(75) Inventors: Kurt E. Thiessen, San Diego, CA (US); Antoni Murcia, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 63 days.

(21) Appl. No.: 10/354,732

(22) Filed: Jan. 30, 2003

(65) Prior Publication Data

US 2004/0149155 A1 Aug. 5, 2004

(51) Int. Cl.[7] ..... B42B 12/02

(52) U.S. Cl. ..... 101/477; 101/492; 101/178; 101/216

(58) Field of Search ..... 101/483, 492, 101/477, 216, 463.1, 177, 178

(56) References Cited

U.S. PATENT DOCUMENTS

| | | | | |
|---|---|---|---|---|
| 5,010,813 A | * | 4/1991 | Buffo | 101/178 |
| 5,142,978 A | * | 9/1992 | Borel | 101/177 |
| 5,394,795 A | | 3/1995 | Ferreol-Ragotin | |
| 5,715,749 A | * | 2/1998 | Miller | 101/216 |
| 5,862,753 A | | 1/1999 | Dolan | |
| 5,953,034 A | | 9/1999 | Yap et al. | |
| 6,038,972 A | * | 3/2000 | Delwiche et al. | 101/216 |
| 6,109,746 A | | 8/2000 | Jeanmaire | |
| 6,393,987 B1 | | 5/2002 | Bolza-Schunemann | |
| 6,748,864 B2 | * | 6/2004 | Verschueren et al. | 101/463.1 |

FOREIGN PATENT DOCUMENTS

EP 0601531 A1 6/1994

OTHER PUBLICATIONS

European Search Report, issued Apr. 2, 2004, by European Patent Office in re European Patent Appl. No. 03019786.7 (the EPO counterpart to above–identified U.S. application), with copies of the six (6) U.S. patents cited thereon, said six U.S. patents having already been made of record in the USPTO in IDS, and Supplemental IDS, along with Form PTO–1449(sheets 1, 2 and 3) filed Jan. 26, 2004 and Apr. 29, 2004, respectively.

* cited by examiner

*Primary Examiner*—Eugene H. Eickholt

(57) ABSTRACT

A printing system has an imaging subsystem, an application subsystem, and a decoupler separating the imaging subsystem from the application subsystem. A method of imaging is also provided. In a placing action, an image is placed on a transfer roll in a first environment. In a moving action, the transfer roll is moved to a second environment. In a transferring action, the image is transferred to a media.

21 Claims, 8 Drawing Sheets

PRINTING SYSTEM

Printing systems often include an inkjet printhead which is capable of forming an image on many different types of media. The inkjet printhead ejects droplets of colored ink through a plurality of orifices and onto a given media as the media is advanced through a printzone. The printzone is defined by the plane created by the printhead orifices and any scanning or reciprocating movement the printhead may have back-and-forth and perpendicular to the movement of the media. Conventional methods for expelling ink from the printhead orifices, or nozzles, include piezo-electric and thermal techniques which are well-known to those skilled in the art. For instance, two earlier thermal ink ejection mechanisms are shown in U.S. Pat. Nos. 5,278,584 and 4,683,481, both assigned to the present assignee, the Hewlett-Packard Company.

In a thermal inkjet system, a barrier layer containing ink channels and vaporization chambers is located between a nozzle orifice plate and a substrate layer. This substrate layer typically contains linear arrays of heater elements, such as resistors, which are individually addressable and energized to heat ink within the vaporization chambers. Upon heating, an ink droplet is ejected from a nozzle associated with the energized resistor. The inkjet printhead nozzles are typically aligned in one or more linear arrays substantially parallel to the motion of the print media as the media travels through the printzone. The length of the linear nozzle arrays defines the maximum height, or "swath" height of an imaged bar that would be printed in a single pass of the printhead across the media if all of the nozzles were fired simultaneously and continuously as the printhead was moved through the printzone above the media.

Typically, the print media is advanced under the inkjet printhead and held stationary while the printhead passes along the width of the media, firing its nozzles as determined by a controller to form a desired image on an individual swath, or pass. The print media is usually advanced between passes of the reciprocating inkjet printhead in order to avoid uncertainty in the placement of the fired ink droplets. If the entire printable data for a given swath is printed in one pass of the printhead, and the media is advanced a distance equal to the maximum swath height in-between printhead passes, then the printing mechanism will achieve its maximum throughput.

Often, however, it is desirable to print only a portion of the data for a given swath, utilizing a fraction of the available nozzles and advancing the media a distance smaller than the maximum swath height so that the same or a different fraction of nozzles may fill in the gaps in the desired printed image which were intentionally left on the first pass. This process of separating the printable data into multiple passes utilizing subsets of the available nozzles is referred to by those skilled in the art as "shingling," "masking," or using "print masks." While the use of print masks does lower the throughput of a printing system, it can provide offsetting benefits when image quality needs to be balanced against speed. For example, the use of print masks allows large solid color areas to be filled in gradually, on multiple passes, allowing the ink to dry in parts and avoiding the large-area soaking and resulting ripples, or "cockle," in the print media that a single pass swath may cause.

A printing mechanism may have one or more inkjet printheads, corresponding to one or more colors, or "process colors" as they are referred to in the art. For example, a typical inkjet printing system may have a single printhead with only black ink; or the system may have four printheads, one each with black, cyan, magenta, and yellow inks; or the system may have three printheads, one each with cyan, magenta, and yellow inks. Of course, there are many more combinations and quantities of possible printheads in inkjet printing systems, including seven and eight ink/printhead systems.

When imaging with one or more inkjet printheads, a high level of image quality depends on many factors, several of which include: consistent printhead to print media spacing, known and controllable registration, movement and positioning of the print media through the print zone, consistent and small ink drop size, consistent ink drop trajectory from the printhead nozzle to the print media, and extremely reliable inkjet printhead nozzles which do not clog.

Unfortunately, inkjet printing systems which are used in industrial printing applications are subjected to many conditions which may adversely affect image quality or reduce image throughput. For example, when using an inkjet printhead to print on a cardboard box, the environment is often dirty, due to the heavy amount of paper fiber and dust commonly found on cardboard as it is fed through a production environment. This dirt and/or paper fiber contamination may cause printhead nozzles to become clogged temporarily or permanently, reducing image quality, and requiring frequent printhead servicing which can reduce imaging throughput and potentially waste ink as the printheads are primed to clear clogged nozzles.

The motion of cardboard boxes, or other industrial media, often cannot be well-coordinated with the firing of the inkjet printhead. This may cause images which are distorted or blurred, resulting in a loss of information. The unpredictable motion of some industrial media also prevents the use of multipass printing. The multiple printing passes should be well-registered with each other to enable high image quality. However, the frequently unpredictable nature of industrial media motion makes multi-pass printing impractical, and if used, often leads to worse image quality than single pass printing in industrial printing applications.

To avoid the image quality issues which inkjet printing systems are susceptible-to in industrial printing applications, manufacturers often will use press-type transfer printing plates. These printing plates may be flat plates or rolls which are engraved with the desired image. The engraved image is then coated with an ink which corresponds to the color plane being imaged, and then the coated plates are pressed into contact with the cardboard being imaged, thereby transferring the ink to the cardboard. This transfer printing process is not dependent on printhead to media spacing, printhead contamination, or ink trajectory, and is less susceptible to registration errors. Separate printing plates or rolls must be used for each color plane being imaged. Unfortunately, however, variable data may not be affordably implemented with engraved plates, since a separate engraved plate needs to be created for each color plane of each printed variation.

Therefore, it is desirable to have a method and mechanism enabling high quality images to be reliably formed in industrial printing applications while preserving the ability to economically image variable data.

DETAILED DESCRIPTION OF THE PREFERRED EMBODIMENTS

FIG. 11 schematically illustrates one embodiment of an industrial printing system 20. The industrial printing system 20 is suitable for imaging on a variety of industrial media, such as cardboards, fabrics, plastics, metals, and woods. Although the concepts described herein are discussed, for convenience, with reference to an industrial environment and an industrial printing system 20, the concepts are equally applicable in non-industrial environments and with non-industrial media such as paper, transparencies, coated media, cardstock, photo quality papers, and envelopes, although the maximum benefit may be derived within industrial applications.

The industrial printing system 20 has an imaging subsystem 22 and an application subsystem 24. The imaging subsystem 22 is responsible for creating a desired image, and the application subsystem 24 is responsible for transferring the desired image to a print media. For the purposes of this disclosure, the term "media" may refer to one or more print medium. A decoupler 26 separates the imaging subsystem 22 from the application subsystem 24 such that the imaging subsystem 22 may located in a first environment and the application subsystem 24 may be located in a second environment.

Figure 1:
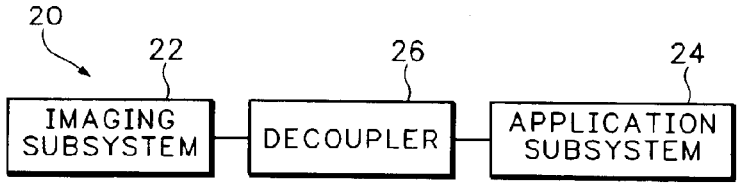
FIG. 1 schematically illustrates one embodiment of an industrial printing system.
Figure 2:
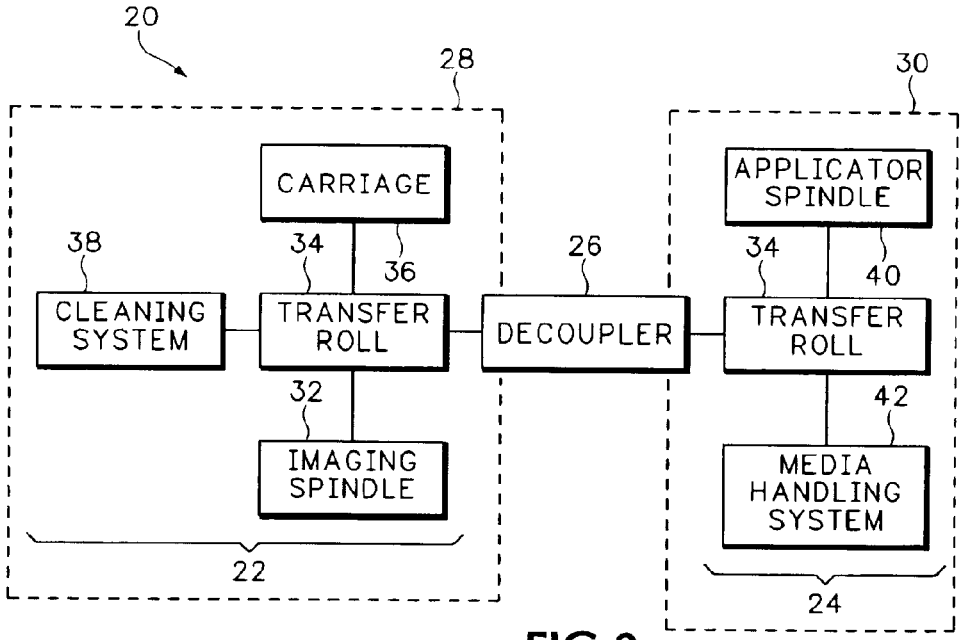
FIG. 2 schematically illustrates another embodiment of an industrial printing system.

FIG. 2 schematically illustrates another embodiment of an industrial printing system 20. The imaging subsystem 22 is located in a first environment, here illustrated as clean environment 28. The application subsystem 24 is located in a second environment, here illustrated as industrial environment 30. The decoupler 26 is in communication with both the clean environment 28 and the industrial environment 30. The industrial environment 30 may be any type of industrial or factory environment where production printing typically occurs. There is no expectation of cleanliness for the industrial environment 30. In fact, industrial environment 30 may have paper dust, wood dust, aerosols, dirt, metal filings, and/or fibers present in the air in such quantities that they might cause reliability issues for inkjet printheads, such as clogged nozzles. By contrast, clean environment 28 is isolated from industrial environment 30, such that dust, dirt, and contaminant levels are kept at or below acceptable levels for inkjet printing, thereby preventing inkjet printheads within the clean environment 28 from becoming clogged due to outside elements. The clean environment 28 does not have to exist in air-tight isolation from the industrial environment 30. Clean environment 28 may be defined by an enclosure. Air may be drawn into the environment 28 from a filtered inlet in the enclosure and expelled through an outlet where the decoupler 26 enters the clean environment 28.

The imaging subsystem 22 of FIG. 2 has an imaging spindle 32, a transfer roll 34 removeably coupled to the imaging spindle 32, a printing carriage 36 which may contain inkjet printheads for imaging on the transfer roll 34, and a cleaning system 38 for cleaning the transfer roll 34. The decoupler 26 may enter the clean environment 28 to transport the transfer roll 34 to the industrial environment 30, where the transfer roll 34 may be removeably coupled to an application spindle 40. The application subsystem 24 has a media handling system 42 which is able to bring a variety of industrial media into contact with the transfer roll 34. A variety of media handling systems are known to those skilled in the art, and an appropriate media handling system 42 may be selected by those skilled in the art, depending on a given application.

The industrial printing system 20, through use of the decoupler 26, is able to form high-quality inkjet images on a transfer roll 34 in a clean environment 28. Printhead spacing can be precisely controlled relative to the predictable and repeatable transfer roll 34 position. The motion of the transfer roll 34 can also be well-defined, enabling the formation of high-quality images via multipass printing onto the transfer roll 34 if desired. After the transfer roll 34 has been imaged, the decoupler 26 transports the transfer roll 34 from the imaging spindle 32 in the imaging subsystem 22 to the application spindle 40 in the application subsystem 24. The transfer roll 34 is then brought into contact with an industrial media being moved by the media handling system 42, and the high quality ink image on the transfer roll 34 (which may contain variable image data) can be transferred onto the industrial media. After transferring the ink image to the industrial media, the decoupler 26 may then transport the transfer roll 34 from the applicator spindle 40 in the industrial environment 30 to the imaging spindle 32 in the clean environment 28. The cleaning system 38 may remove any non-transferred ink from the transfer roll 34 prior to re-imaging by the printhead carriage 36.

Figure 3:
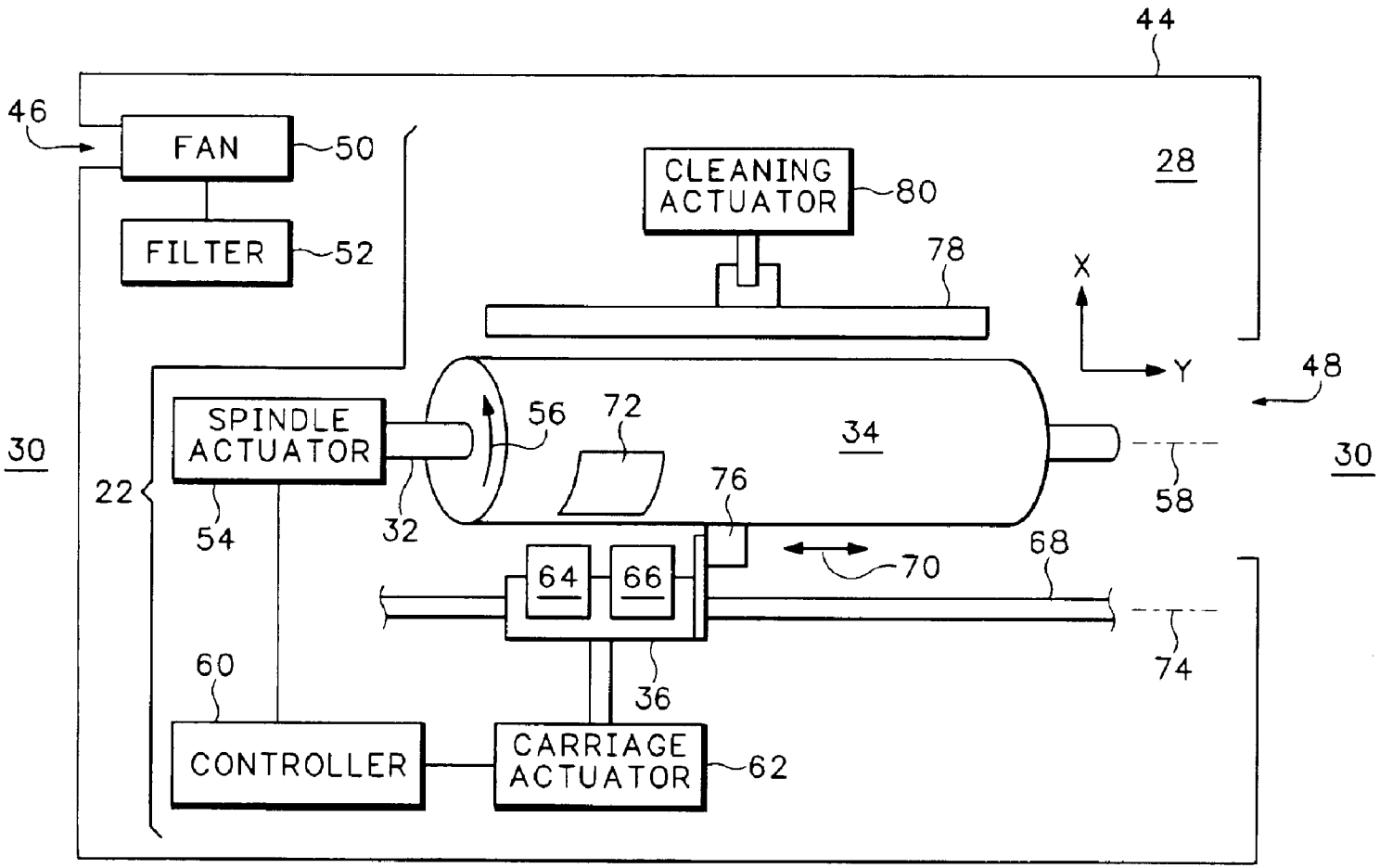
FIG. 3 schematically illustrates one embodiment of an imaging subsystem in an industrial printing system.

FIG. 3 schematically illustrates one embodiment of an imaging subsystem 22 in an industrial printing system 20. An enclosure 44 separates the clean environment 28 from the industrial environment 30. The enclosure 44 defines an inlet 46 and an outlet 48. A fan 50 is coupled to the inlet 46, and is configured to draw air from the industrial environment 30, into the inlet 46, and push the air through a filter 52 and into the clean environment 28. The filtered air then flows out of the outlet 48, creating an airflow barrier against contamination inside the clean environment 28. The types and levels of filtration provided by filter 52, the air flow created by the fan 50, and the sizes of the inlet 46 and the outlet 48 may be determined by those skilled in the art to provide a desired level of cleanliness in the clean environment 28. The outlet 48 should be large enough to provide access for the transfer roll 34 to be removed by the decoupler 26. In some applications, the inlet 46, the fan 50, and the filter 52 may not be necessary. In these situations, the enclosure 44 may be enough to maintain a suitable level of cleanliness in the clean environment 28 versus the industrial environment 30. In other applications, the enclosure may not be necessary at all, provided the imaging subsystem 22 and the application subsystem 24 are separated by enough distance or environmental condition that the imaging subsystem effectively operates in a clean environment 28 as compared to the industrial environment 30 that the application subsystem 24 operates in. While the embodiment illustrated in FIG. 3 shows an enclosure 44 of a particular design, the other illustrations herein do not illustrate any type of enclosure for simplicity, and to acknowledge the many ways by which a clean environment 28 may be created and maintained for the imaging subsystem 22. It should be understood that all of the embodiments discussed herein, as well as their functional and physical equivalents may or may not have an enclosure 44, of various designs, provided a suitable clean environment 28 is present where the imaging subsystem 22 operates.

The embodiment of an imaging subsystem 22 illustrated in FIG. 3 has the imaging spindle 32 coupled to a spindle actuator 54. The spindle actuator 54 rotates the imaging spindle 32 and therefore the transfer roll 34 in a first arcuate direction 56 about the spindle axis 58, according to instructions received from a controller 60. The controller 60 may be a computer, a microprocessor, an Application Specific Integrated Circuit (ASIC), digital electronics, analog electronics, or any combination thereof. The imaging subsystem 22 also has a carriage actuator 62 coupled to the printhead carriage 36. In this embodiment, the printhead carriage 36 has two printheads, black printhead 64 and color printhead 66. The transfer roll 34 receives ink from the printheads 64, 66. The black ink printhead 64 is illustrated herein as containing a pigment-based ink. For the purposes of illustration, color ink printhead 66 is described as containing three separate dye-based inks which are colored cyan, magenta, and yellow, although it is apparent that the color printhead 66 may also contain pigment-based inks in some implementations. It is also apparent that other types of inks may also be used in the printheads 64 and 66, such as paraffin-based inks, as well as hybrid or composite inks having both dye and pigment characteristics.

The carriage actuator 62 is able to move the printhead carriage 36 back and forth along a carriage guide rod 68 in positive and negative Y-axis directions. The illustrated imaging subsystem 22 uses replaceable printheads 64, 66 where each printhead has a reservoir that carries the entire ink supply as the printhead traverses 70 along the transfer roll 34. As used herein, the term "printhead" may also refer to an "off-axis" ink delivery system, having main stationary reservoirs (not shown) for each ink (black, cyan, magenta, yellow, or other colors depending on the number of inks in the system) located in an ink supply region. In an off-axis system, the printheads may be replenished by ink conveyed through a flexible tubing system from the stationary main reservoirs which are located "off-axis" from the path of printhead travel, so only a small ink supply is propelled by carriage 36. Other ink delivery or fluid delivery systems, such as printheads which have ink reservoirs that snap onto permanent or semi-permanent print heads may also be employed in the embodiments described herein and their equivalents.

By rotating 56 the transfer roll 34 and traversing 70 the printhead carriage 36 along the transfer roll 34, the printheads 64, 66 may selectively eject ink to form an image 72 in a spiral fashion on the transfer roll 34. As needed, the inkjet carriage 36 may be moved along the carriage guide rod 68 to a servicing region (not shown) where a service station may perform various servicing functions known to those skilled in the art, such as, priming, scraping, and capping for storage during periods of non-use to prevent ink from drying and clogging the inkjet printhead nozzles.

Two embodiments of cleaning systems are illustrated in the imaging subsystem of FIG. 3. A cleaning pad 76 may be mounted to the printhead carriage 36 such that the pad 76 slidably engages the transfer roll 34 when the printhead carriage 36 is scanned along the transfer roll 34. The cleaning pad 76 will remove any ink or debris from the transfer roll 34 prior to application of new ink, provided the printhead carriage 36 is scanned in a positive Y-axis direction, allowing the cleaning pad 76 to lead the printheads 64, 66 when imaging. Alternatively, a full-length cleaning pad 78 may be provided and coupled to a cleaning actuator 80. The full-length cleaning pad 78 is sized to extend at least the printable length of the transfer roll 34. Prior to imaging, the cleaning actuator 80 may move the cleaning pad 78 in the negative X-axis direction such that the cleaning pad 78 engages the transfer roll 34. The spindle actuator 54 can then rotate the transfer roll 34 a desired number of revolutions, allowing the pad 78 to clean ink and debris from the transfer roll. The cleaning actuator 80 may then move the cleaning pad 78 in the positive X-axis direction so that the cleaning pad 78 disengages the transfer roll 34. At this point, a new image 72 may be formed on the transfer roll 34. The cleaning pads 76 and 78 may alternatively be wipers, scrapers, or some combination of wipers, scrapers, and/or pads.

Figure 4:
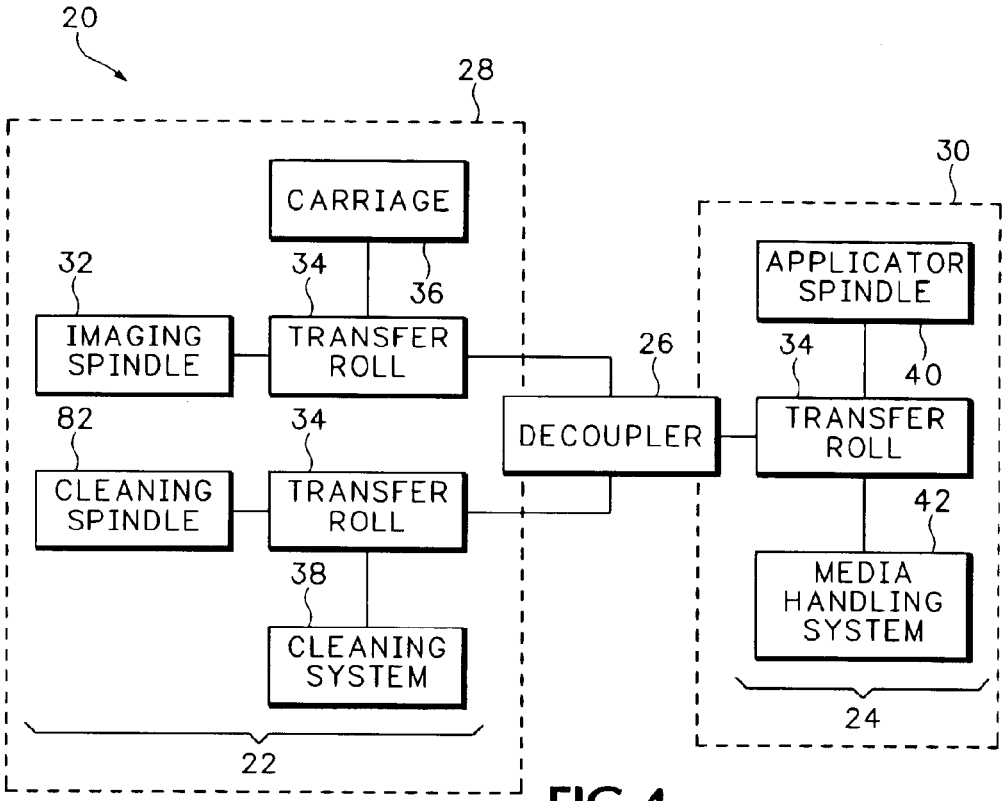
FIG. 4 schematically illustrates another embodiment of an industrial printing system.

FIG. 4 schematically illustrates another embodiment of an industrial printing system 20. The embodiment of FIG. 4 is similar to the embodiment of FIG. 2, as previously discussed, with the exception that cleaning of the transfer roll 34 does not occur while the transfer roll 34 is coupled to the imaging spindle 32. Instead, the decoupler 26 transports the transfer roll 34 to a separate cleaning spindle 82 where the cleaning system 38 may clean the transfer roll 34, and then the decoupler 26 transports the transfer roll 34 to the imaging spindle 32 for imaging. By separating the cleaning process to a separate cleaning spindle 82, a more robust cleaning solution may be implemented, including liquid or solvent cleaning and cleaning solutions which would not fit at the same location as the printhead carriage 36. With the embodiment of FIG. 4, cleaning may occur in parallel to imaging, to speed imaging throughput when multiple transfer rolls 34 are used.

Figure 5A:
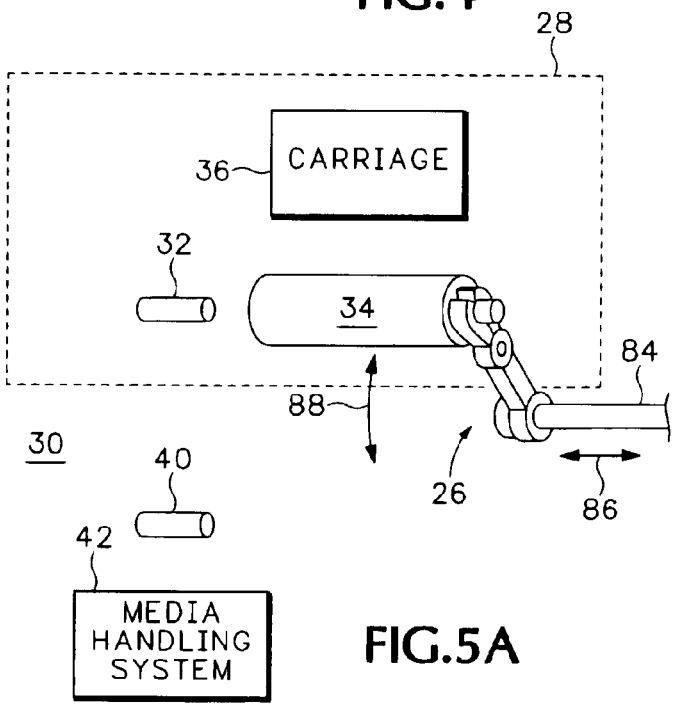
FIGS. 5A–5C schematically illustrate separate embodiments of an industrial printing system, each having different embodiments of a decoupler.
Figure 5B:
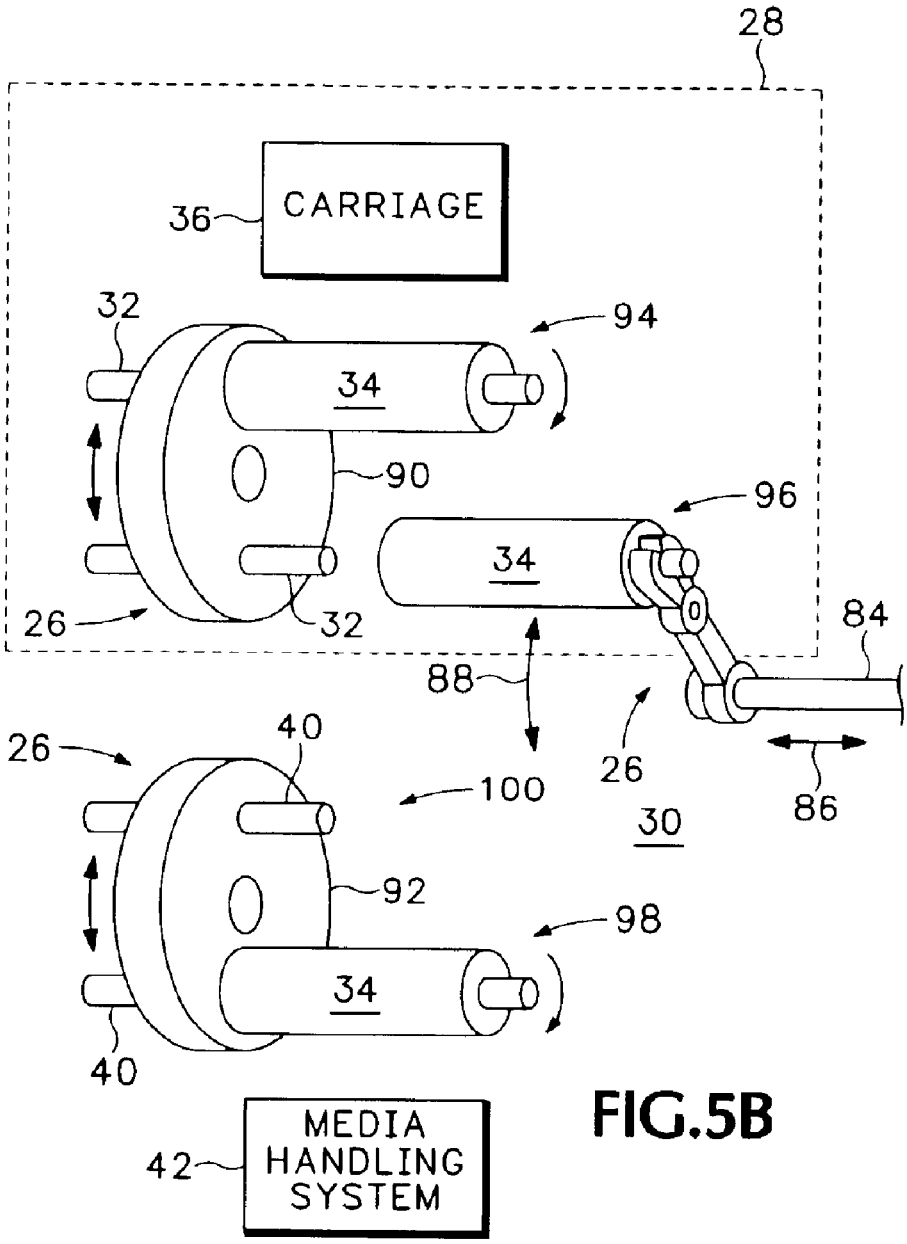
Figure 5C:
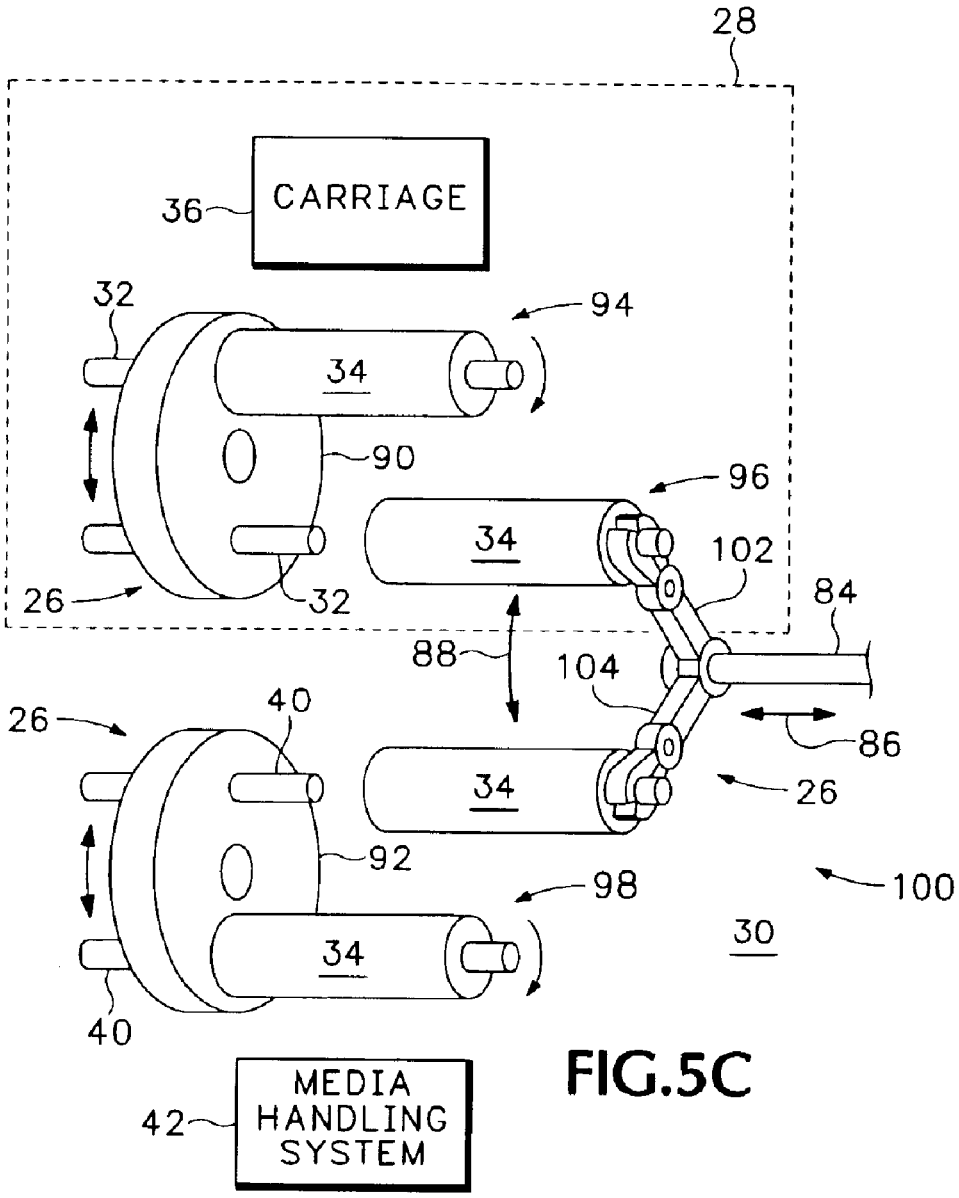

FIGS. 5A–5C schematically illustrate separate embodiments of an industrial printing system 20, each having different embodiments of a decoupler 26. In the embodiment of FIG. 5A, the decoupler 26 has a robotic arm 84 which can move back and forth along an axis 86 parallel to the imaging spindle 32 axis and the application spindle 40 axis. The robotic arm is also able to translate 88 between positions over the imaging spindle 32 and over the application spindle 40. The robotic arm 84 is configured to grab the transfer roll 34 after it has been imaged by the printhead carriage 36, remove the transfer roll 34 from the imaging spindle 32, deliver the imaged transfer roll 34 to the application spindle 40 in the industrial environment 30, and release the transfer roll 34. The imaging spindle 32 and the application spindle 40 may each be keyed so that the transfer roll 34, when on a given spindle 32, 40, will rotate when the spindles 32, 40 rotate. After the image on the transfer roll 32 has been transferred to an industrial media carried by the media handling system 42, the robotic arm may then pick up the transfer roll, and return it to the clean environment 28 for further imaging.

In the embodiment of FIG. 5B, the decoupler 26 has a robotic arm 84 which can move back and forth along an axis 86 parallel to the imaging spindle 32 axis and the application spindle 40 axis. The decoupler 26 also has an imaging turntable 90 and an application turntable 92. The imaging turntable 90 has a plurality of imaging spindles 32, while the application turntable 92 has a plurality of application spindles 40. The imaging spindles 32 and the application spindles 40 are rotateably coupled to their respective turntables 90 and 92, such that the spindles 32, 40 may be driven on one side of the turntables 90, 92 thereby causing a transfer roll 34 coupled to the spindle 32, 40, on the other side of the turntables 90, 92, to rotate. The imaging turntable 90 may move the imaging spindles 32 to an imaging position 94 where the printhead carriage 36 is able to form an image on a transfer roll 34. The imaging spindles 32 may also be moved to an imaging transport position 96 where the robotic arm 84 can grasp a transfer roll 34, and remove it from its imaging spindle 32. Likewise, the application turntable 92 may move the application spindles 40 to an application position 98 where the media handling system 42 can bring an industrial media into contact with the transfer roll 34 to receive an image. The application spindles 40 may also be moved to an application transport position 100 where the robotic arm 84 can grasp a transfer roll 34, and remove it from its application spindle 40. A decoupler 26, such as the one embodied in FIG. 5B requires at least one imaging spindle 32 or one application spindle 40 be open, so the robotic arm 84 may have a location to swap transfer rolls 34 to.

In the embodiment of FIG. 5C, the decoupler 26 is similar to that illustrated in FIG. 5B, with the difference that the robotic arm 84 has two hands 102, 104. While the first hand 102 grasps a transfer roll 34 from an imaging spindle 32 in the imaging transport position 96, the second hand 104 grasps a transfer roll 34 from an application spindle 40 in the application transport position 100. The robotic arm 84 then rotates to swap the two transfer rolls 34 simultaneously, so that a recently imaged transfer roll 34 is now on the application turntable 92, and a recently used transfer roll 34 is now on the imaging turntable 90. As in FIG. 5B, the imaging turntable 90 rotates to bring used transfer rolls 34 to the printhead carriage 36 for imaging, and the application turntable 92 rotates to bring imaged transfer rolls 34 to the media handling system 42 for transfer printing.

Other functionally or mechanically equivalent decouplers 26 will be apparent to those skilled in the art, and the schematic illustrations contained herein are not intended to be limiting in any way. Equivalents are intended to be included in the scope of the claims. For example, a robotic arm 84 may not be necessary in a system where the spindles move between the clean environment 28 and the industrial environment 30, by way of a single turntable, or other translation device. Also, although the transfer rolls 34 have been illustrated as cylinders or drums in the embodiments herein, the transfer rolls may also be flexible belts that operate between rollers. Drums and cylinders have been used in the illustrations for simplicity.

Figure 6:
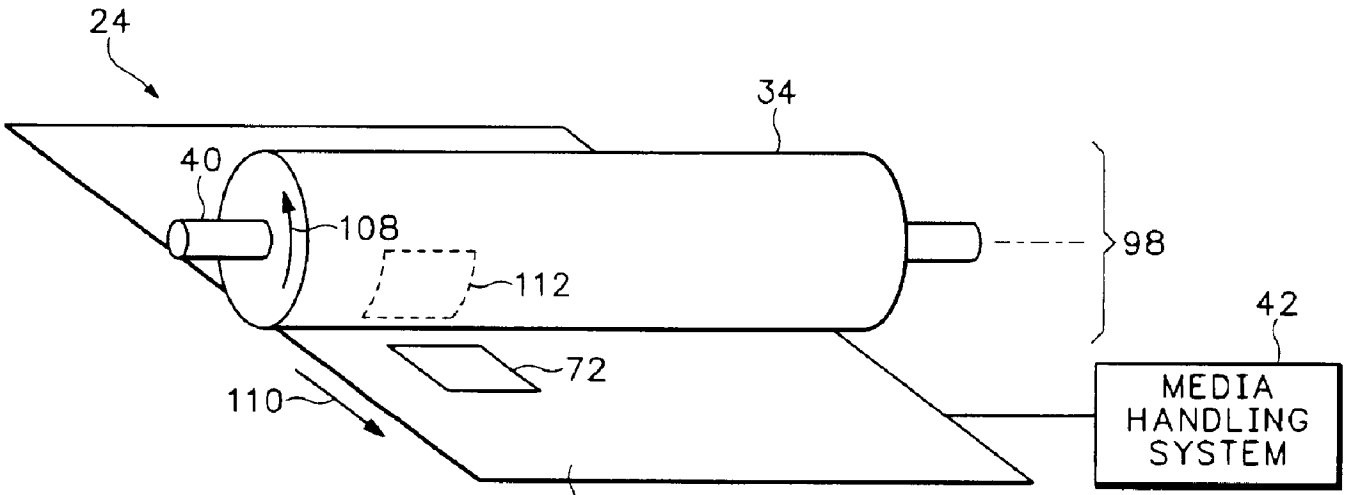
FIG. 6 schematically illustrates one embodiment of an application subsystem in an industrial printing system.

FIG. 6 schematically illustrates one embodiment of an application subsystem 24 in an industrial printing system 20. The transfer roll 34 is removeably coupled to the application spindle 40, here shown in the application position 98. The media handling system 42 is coupled to an industrial media 106. The transfer roll 34 is rotated 108 in such a way to match or substantially match the speed and direction 110 of the industrial media 106. The industrial media 106 contacts the transfer roll 34, and the ink image 72 is transferred to the industrial media 106. While it is ideal to have a complete transfer of ink to the industrial media 106, in practice, a residual amount of untransferred ink 112 may remain on the transfer roll 34. This residual ink may be removed by the cleaning system 38 previously discussed with respect to FIG. 2 after the transfer roll 34 is returned to the clean environment 28.

Figure 7B:
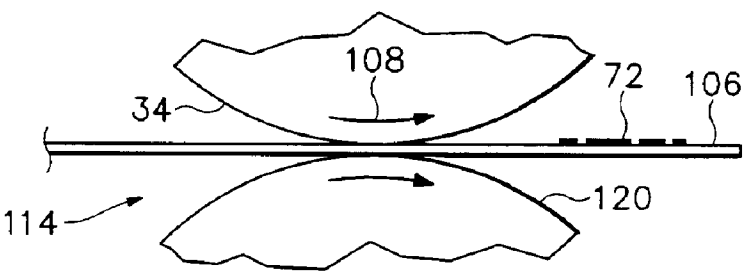
FIGS. 7A–7B schematically illustrate separate embodiments of a backing mechanisms in an industrial printing system.
Figure 7A:
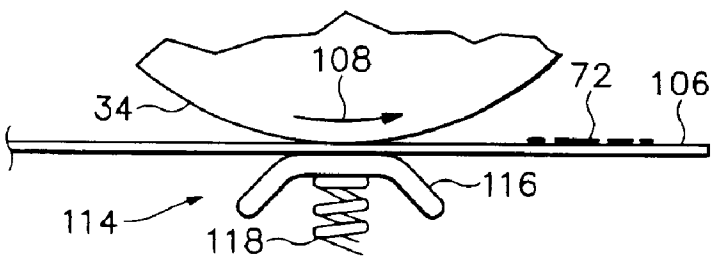

When the transfer roll 34 is in the application position 98, and in contact with the industrial media 106, some type of backing mechanism may be desirable to ensure adequate pressure and or contact between the transfer roll 34 and the industrial media 106. FIGS. 7A–7B schematically illustrate separate embodiments of backers 114 in an industrial printing system. In FIG. 7A, the backer 114 is a backer bar 116 which may be biased towards the transfer roll 34 by a spring 118 or similar device. Other backer bars 116 may be fixed in position and used without a biasing spring 118. In FIG. 7B, the backer 114 is a backer roller 120 which can either be biased towards the transfer roll 34 by a spring, or preset to a fixed interference or gap relative to the transfer roll 34.

Figure 8:
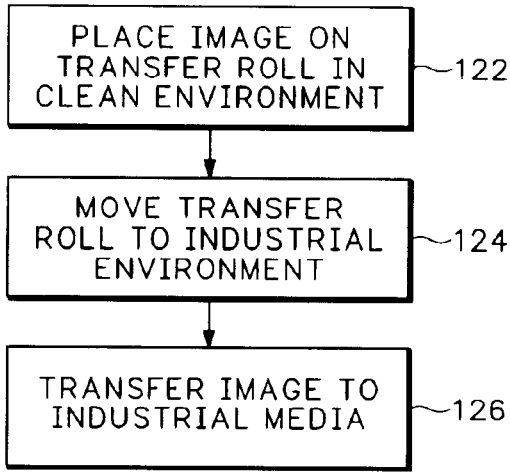
FIG. 8 illustrates one embodiment of actions which can be used to image industrial media.

FIG. 8 illustrates one embodiment of actions which can be used to image industrial media 106 with an industrial imaging system 20. In a placing action, an image 72 is placed 122 on a transfer roll 34 in a clean environment 28. In a moving action, the transfer roll 34 is moved 124 to an industrial environment 30. In a transferring action, the image 72 is transferred 126 to an industrial media 106. This type of decoupled printing, where imaging takes place in a clean environment 28, while transfer to a media takes place in an industrial environment has several advantages. While the embodiments described herein and their equivalents may be used to reliably create multiple copies of the same fixed image on a given media, the image area may also be filled with variable data at no additional cost to the operator. Custom engraved or lithographed plates are not necessary. Many print quality defects and reliability issues may be avoided by decoupling the inkjet printhead from the industrial environment. Less priming of the inkjet printhead should be needed, resulting in less wasted ink, and a more appealing cost structure for the operator. High quality, multiple-pass images may be formed on the transfer roll and transferred in a single pass to the industrial media, thereby enabling higher quality images on the industrial media which were difficult to obtain on a variety of media in the past. This system is robust, yet allows for variable image data to be printed in an industrial environment.

Figure 9:
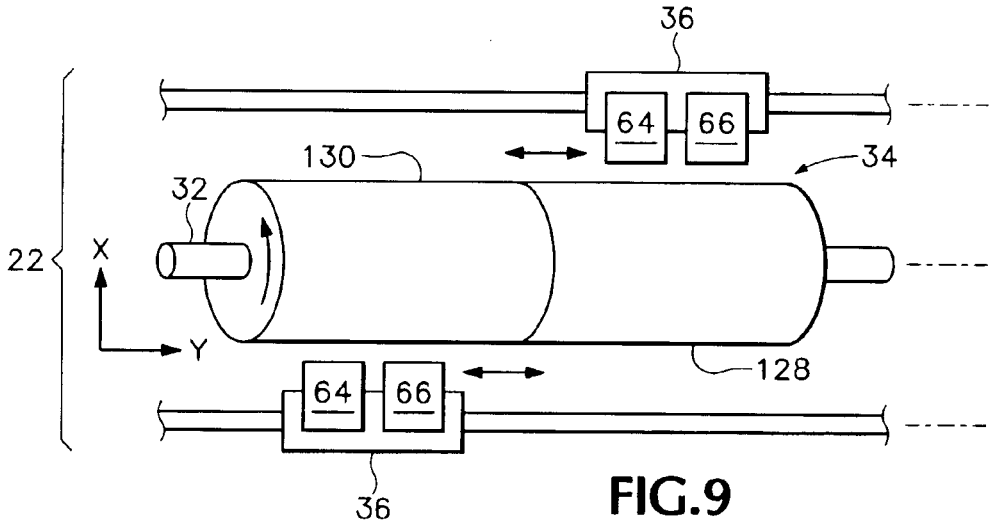
FIG. 9 schematically illustrates another embodiment of an imaging subsystem in an industrial printing subsystem.

FIG. 9 schematically illustrates another embodiment of an imaging subsystem 22 in an industrial printing subsystem 20. In some situations, the intended image which will be transferred onto an industrial media 106 may contain a known fixed image area, and a variable image area. For example, cardboard boxes may be printed with a company's return address and logo as a fixed image, regardless of which box is being printed upon. A defined portion of the cardboard box may also have a variable image, such as a customer's mailing address. To speed production, it may be desirable to use transfer rolls 34 which have a plurality of surface regions, such as non-porous region 128 and porous region 130 in FIG. 9. After ink has been applied to the porous region 130 of the transfer roll 34, it may be repeatedly transferred to multiple cardboard boxes, or other media, before needing to be re-imaged on the transfer roll 34. By contrast, ink applied to the non-porous region 128 of the transfer roll 34 may only be transferred to a single card board box, or other media, before needing to be re-imaged. This makes the non-porous region 128 more suitable for variable printed information, while the porous region 130 is more suited to fixed printed information. Transfer rolls 34 with multiple regions of porous material 130 and non-porous material 128 can be re-imaged faster because the porous regions 130 may be loaded with ink a single time over multiple transfers, leaving only the non-porous region 128 to be reimaged for each transferred print to a media. Although a single printhead carriage 36 may be used to image in both the non-porous regions 128 and the porous regions 130, the embodiment of FIG. 9 illustrates multiple inkjet printhead carriages 36, each one having printheads 64, 66 with ink tailored to the types of regions they are printing on, whether it be porous 130 or non-porous 128. Imaging of the transfer roll can occur in a manner consistent with the imaging subsystems 22 previously described.

Figure 10:
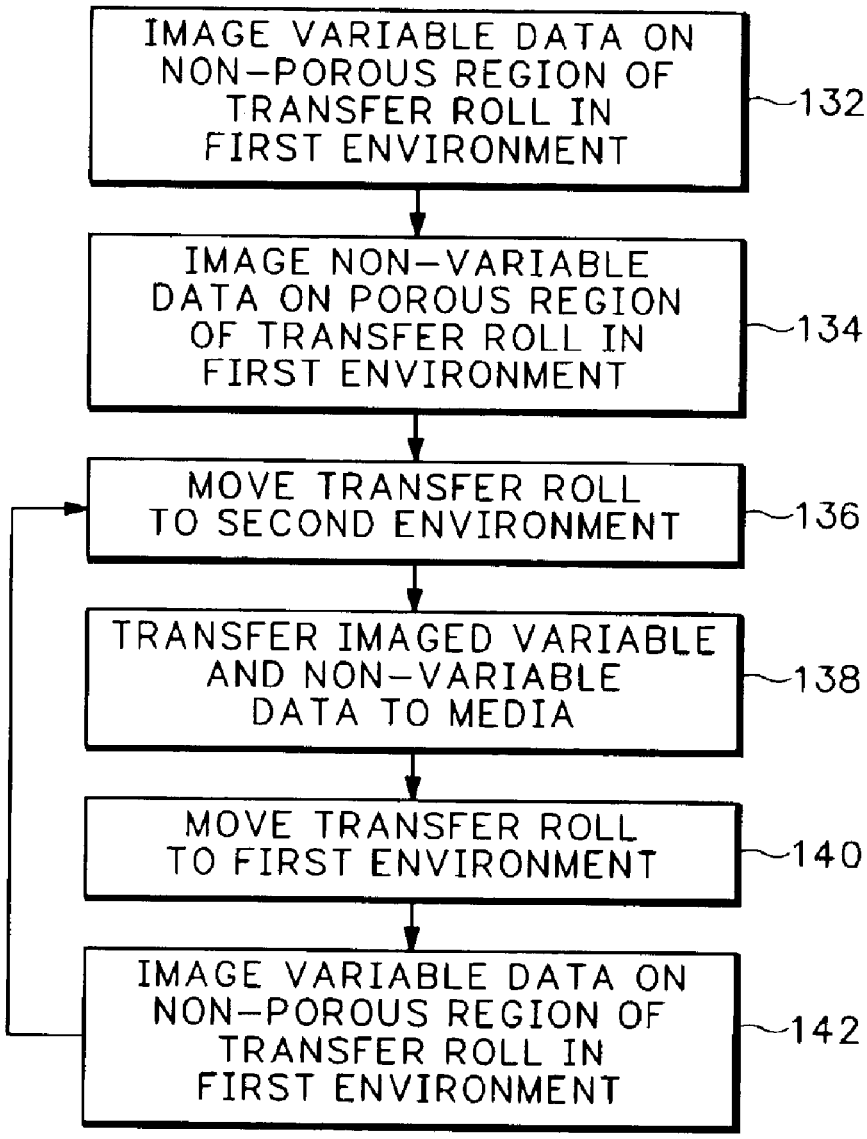
FIG. 10 illustrates one embodiment of actions which can be used to image industrial media.

FIG. 10 illustrates one embodiment of actions which can be used to image industrial media 106. In an imaging action, variable data is imaged 132 on a non-porous region 128 of a transfer roll 34 in a first environment. In another imaging action, non-variable data is imaged 134 on a porous region 130 of the transfer roll 34 in the first environment. In a moving action, the transfer roll is moved 136 to a second environment. In a transferring action, the imaged variable and non-variable data are transferred 138 to a media. In a moving action, the transfer roll 34 is moved 140 to the first environment. In a third imaging action, variable data is imaged 142 on the non-porous region 128 of the transfer roll 34 in the first environment. The moving action 136, transferring action 138, moving action 140, and the third imaging action 142 are then repeated as desired.

It is apparent that a variety of other structurally and functionally equivalent modifications and substitutions may be made to construct a printing system 20 according to the concepts covered herein depending upon the particular implementation, while still falling within the scope of the claims below.

We claim:

1. A printing system, comprising:

an imaging subsystem including an imaging spindle, a transfer roll which can be removably coupled to the imaging spindle, and a printhead carriage which can form an image on the transfer roll when the transfer roll is coupled to the imaging spindle;

an application subsystem including an applicator spindle, wherein the transfer roll can be removably coupled to the applicator spindle, and a media handling system which can bring a media into contact with the transfer roll when the transfer roll is coupled to the applicator spindle; and a decoupler separating the imaging subsystem from the application subsystem.

2. The printing system of claim 1, wherein the decoupler may be configured to transport the transfer roll between the imaging spindle and the applicator spindle.

3. The printing system of claim 1, further comprising a cleaning system which is configured to clean the transfer roll prior to the printhead carriage forming an image on the transfer roll.

4. The printing system of claim 3, wherein the cleaning system comprises:

means for cleaning coupled to the printhead carriage.

5. The printing system of claim 3, wherein the cleaning system comprises:

a cleaning actuator; and means for cleaning coupled to the cleaning actuator.

6. The printing system of claim 3, wherein the cleaning system comprises:

a cleaning spindle, wherein the transfer roll may be removeably coupled to the cleaning spindle; and means for cleaning coupled to the transfer roll when the transfer roll is coupled to the cleaning spindle.

7. The printing system of claim 1, wherein the decoupler further comprises:

a robotic arm configured to move the transfer roll from the imaging spindle in a first environment to the application spindle in a second environment.

8. The printing system of claim 1, wherein the decoupler further comprises:

an imaging turntable coupled to the imaging spindle;

an application turntable coupled to the application spindle;

a robotic arm configured to move the transfer roll from the imaging spindle in a first environment to the application spindle in a second environment.

9. The printing system of claim 8, wherein the robotic arm has a first hand and a second hand, wherein:

the first hand may be configured to move a first transfer roll from the imaging spindle in the first environment to the application spindle in the second environment; and the second hand may be configured to move a second transfer roll from the application spindle in the second environment to the imaging spindle in the first environment.

10. The printing system of claim 9, wherein the first hand may be configured to move the first transfer roll at the same time that the second hand moves the second transfer roll.

11. The printing system of claim 1, wherein the decoupler comprises:

means for moving the transfer roll from the imaging spindle in a first environment to the application spindle in a second environment; and means for moving the transfer roll from the application spindle in the second environment to the imaging spindle in the first environment.

12. The printing system of claim 1, wherein the transfer roll further comprises:

a non-porous region; and a porous region.

13. The printing system of claim 1, wherein the imaging subsystem further comprises a second printhead carriage which can form an image on the transfer roll when the transfer roll is coupled to the imaging spindle.

14. The printing system of claim 13, wherein the transfer roll further comprises:

a non-porous region; and a porous region.

15. The printing system of claim 14, wherein:

the printhead carriage is configured to form an image on the non-porous region of the transfer roll when the transfer roll is coupled to the imaging spindle; and the second printhead carriage is configured to form an image on the porous region of the transfer roll when the transfer roll is coupled to the imaging spindle.

16. The printing system of claim 1, wherein the transfer roll is selected from the group consisting of cylinders, drums, and belts.

17. The printing system of claim 1, further comprising:

an enclosure substantially surrounding the imaging system, wherein the enclosure defines an inlet and an outlet:

a fan coupled to the inlet;

a filter coupled to the fan, such that air outside the enclosure may be filtered and brought into the enclosure; and wherein the outlet is sized to allow the decoupler access to the imaging subsystem.

18. A printing system comprising:

an imaging subsystem including an imaging spindle; a transfer roll which can be removably coupled to the imaging spindle; and means for forming an image on the transfer roll when the transfer roll is coupled to the imaging spindle;

an application subsystem including an applicator spindle, wherein the transfer roll can be removably coupled to the applicator spindle; and a media handling system which can bring a media into contact with the transfer roll when the transfer roll is coupled to the applicator spindle; and a decoupler separating the imaging subsystem from the application subsystem.

19. The printing system of claim 18, wherein the application subsystem further comprises a backer opposite the transfer roll when the transfer roll is coupled to the applicator spindle.

20. The printing system of claim 19, wherein the backer is selected from the group consisting of a backer bar and a backer roller.

21. A printing system, comprising:

an imaging subsystem, wherein the imaging subsystem comprises:

at least one imaging spindle;

at least one transfer roll which can be removably coupled to the at least one imaging spindle; and means for forming an image on the at least one transfer roll when the at least one transfer roll is coupled to the imaging spindle;

an application subsystem, wherein the application subsystem comprises:

at least one applicator spindle, wherein the at least one transfer roll can be removably coupled to the at least one applicator spindle; and a media handling system which can bring a media into contact with the at least one transfer roll when the at least one transfer roll is coupled to the at least one applicator spindle;

a decoupler separating the imaging subsystem from the application subsystem wherein the decoupler may be configured to transport the at least one transfer roll between the at least one imaging spindle and the at least one applicator spindle, wherein the decoupler comprises:

means for moving the at least one transfer roll from the at least one imaging spindle in a first environment; and means for moving the at least one transfer roll from the at least one imaging spindle in the first environment; and a cleaning system which is configured to clean the at least one transfer roll prior to the forming an image on the at least one transfer roll.

* * * * *